US006378324B1

(12) United States Patent
Percy et al.

(10) Patent No.: US 6,378,324 B1
(45) Date of Patent: Apr. 30, 2002

(54) THERMALLY REGULATED STORAGE CONTAINER

(75) Inventors: Charles W. Percy, Chesterfield; John P. Huffman, Fenton, both of MO (US)

(73) Assignee: Crane Co., Bridgeton, MO (US)

( * ) Notice: Subject to any disclaimer, the term of this patent is extended or adjusted under 35 U.S.C. 154(b) by 0 days.

(21) Appl. No.: 09/632,475

(22) Filed: Aug. 4, 2000

Related U.S. Application Data

(63) Continuation-in-part of application No. 09/427,240, filed on Oct. 26, 1999, now Pat. No. 6,170,285.

(51) Int. Cl.[7] ..... F25D 19/02

(52) U.S. Cl. ..... 62/448; 62/449; 62/450; 221/150 R

(58) Field of Search ..... 62/448, 449, 450, 62/255, 302; 221/150 R, 150 HC

(56) References Cited

U.S. PATENT DOCUMENTS 3,712,078 A * 1/1973 Maynard et al. ..... 62/448
4,019,339 A * 4/1977 Anderson ..... 62/449 X
4,035,608 A * 7/1977 Stromquist et al.
4,206,615 A * 6/1980 Sobajima et al.
4,326,620 A * 4/1982 Felix et al.
4,509,339 A * 4/1985 Mehlan et al. ..... 62/450
4,730,450 A * 3/1988 Ficken
4,815,302 A * 3/1989 Aoki et al. ..... 221/150 HC X
4,827,729 A * 5/1989 Groth et al.
4,977,754 A * 12/1990 Upton et al. ..... 221/150 R X
5,199,273 A * 4/1993 Silva et al. ..... 62/450 X
5,417,081 A * 5/1995 Rudick et al. ..... 62/448 X
5,678,421 A * 10/1997 Maynard et al. ..... 62/448 X
5,875,645 A * 3/1999 Dunnigan
5,901,877 A * 5/1999 Fujiu ..... 221/150 HC
5,971,205 A * 10/1999 Michaels et al.
6,051,820 A * 4/2000 Poix et al.
6,094,934 A * 8/2000 Rand et al. ..... 62/448 X

* cited by examiner

*Primary Examiner*—Denise L. Esquivel
*Assistant Examiner*—Chen-Wen Jiang
(74) *Attorney, Agent, or Firm*—Hughes & Luce, L.L.P

(57) ABSTRACT

The thermally regulated storage container of the present invention comprises a cabinet housing with an one open face. A self-sealing and self aligning cover provides an environmental seal between an insulated storage area within the cabinet housing and an external environment. A modular environmental control unit is removably installed within the cabinet. This unit can control temperature, pressure, humidity or any other environmental condition. A ducting system within the cabinet mates with the environmental control unit. An environmental monitoring system monitors internal conditions of the storage container and provides an input to a control system operable to direct the modular environmental control. This ensures that the desired internal conditions are maintained.

62 Claims, 10 Drawing Sheets

THERMALLY REGULATED STORAGE CONTAINER

RELATED APPLICATIONS

This application claims priority to and is a continuation in part of U.S. patent application Ser. No. 09/427,240 entitled "Vending Machine," filed on Oct. 26, 1999 (now U.S. Pat. No. 6,170,285). Furthermore U.S. patent application Ser. No. 09/427,240, entitled "Vending Machine," is hereby incorporated by reference.

TECHNICAL FIELD OF THE INVENTION

This invention relates generally to storage containers and, more particularly, to a thermally regulated storage container that dispenses various products to customers upon insertion of adequate currency or its equivalent.

BACKGROUND OF THE INVENTION

Vending machines are often exposed to harsh environments. Extreme temperatures, humidity and sunlight all negatively impact products contained within vending machine. Additionally, vending machines are targets of vandals seeking either products or monies contained therein. Vandals also often deface or destroy the machines themselves. A typical method to protect these machines is to install the machine within a cage preventing unwanted access. This limits the size, placement, and configuration of the vending machine once the protective structure or cage has been constructed.

Other problems with vending machines involve protecting their contents from the environment. Customers prefer to see the products they are choosing, but this often exposes the sensitive products, such as chocolate bars, to direct sunlight, causing them to melt or spoil.

This is particularly true for machines intended for outdoor use. Existing machines are typically unable to satisfactorily cool the internal temperature within the food storage area. This is true whether the machine is vending chilled, refrigerated, or frozen foods. This is largely due to the use of a large glass front through which customers view the products. This glasses front allows substantial heat transfer, particularly when exposed to direct sunlight. Although in cold weather, heat transfer can be in the opposite direction, from the inside to the outside of the food storage area.

To combat this problem, many vending machines incorporate refrigeration systems that allow chilled, refrigerated, or frozen foods to be protected and vended. The basic refrigeration system consists of an evaporator, fan, compressor, and condenser. Many different system configurations currently in use provide cooling. Some are permanently installed in the vending machine while others are removably installed for greater ease of service. Since some sensitive items spoil quickly on failure of the refrigeration system, it is essential to minimize down time of the refrigeration system in order to preserve these products. Removable refrigeration systems are commonly entirely replaced by new operating refrigeration systems on site. The defective unit is then repaired at an offsite facility at a later, more convenient time. This tends to minimize down time, but the amount of time required to install the new refrigeration unit depends upon system configuration, the difficulty of removal of the old system, and ease of installation of the new system. Known existing systems require partial disassembly of the vending machine to remove the refrigeration system, prolonging down time and enhancing the potential for spoilage of the machine's contents. One solution is to use a refrigeration unit that can slide in and out of the vending machine. This refrigeration unit is aligned to interconnecting ductwork needed to circulate cooled air into refrigerated portions of the vending machine and remove warmed air therefrom. Such a machine is disclosed in U.S. Pat. No. 4,730,750 (the '750 patent), which is hereby incorporated by reference. The '750 patent provides a self-contained refrigeration unit with duct work that mates when aligned to duct work in the vending machine. Here, the refrigeration unit slides into the vending machine and then the ductwork is aligned. Once aligned, the ducts are engaged to form a seal between the two ducting systems. Alignment tracks on the floor of the vending machine help align the ductwork from right to left. However, the alignment of this system is often difficult resulting in incomplete seals between the two ducting systems.

The monetary unit, where the customer inserts his or her money to make a purchase, is another troublesome spot. Limited space within the vending machine creates difficulties in mounting and servicing various components of the monetary system such as the bill validator, coin changer and microprocessors, which control various functions of the vending machine. Security in this area is especially important as vandals often attempt to gain entry or "jackpot" the mechanisms.

SUMMARY OF THE INVENTION

The present invention provides a thermally regulated storage cabinet that substantially eliminates problems associated with previously developed outdoor storage cabinets.

More specifically, the present invention provides a thermally regulated storage cabinet that can be used as an outdoor vending machine in a variety of environmental extremes.

The thermally regulated storage container of the present invention comprises a cabinet housing with an open face. A self-sealing and self-aligning cover provides an environmental seal between a storage area within the cabinet housing and the external environment. A modular environmental control unit is removably installed within the cabinet. This unit can control temperature, pressure, humidity or any other environmental condition. A ducting system within the cabinet mates with the environmental control unit, increasing internal efficiency. An environmental monitoring system monitors internal conditions of the storage container and provides an input to a control system operable to direct the functions of the modular environmental control. This ensures that the desired internal conditions are maintained.

In an additional embodiment, the thermally regulated storage container of the present invention also includes a protective exterior layer constructed from a material such as a polycarbonate or LEXAN® to protect exterior surfaces from external conditions. This exterior may also incorporate anti-graffiti properties preventing unwanted destruction of the exterior surfaces of the present invention.

In yet another embodiment the present invention may include a vending mechanism and product dispensing system. This allows the present invention to be used as an outdoor vending machine in a wide variety of environmentally hostile conditions while protecting an owner's interest in both the contents and the container itself.

The present invention overcomes the above-described difficulties and disadvantages of prior art storage containers by providing a thermally regulated storage container. More specifically the present invention provides a thermally regulated storage container having a self-aligning self-contained refrigeration and heating unit. This refrigeration and heating unit can easily and quickly be installed or removed from the storage container.

The present invention provides advantages over the prior storage containers by providing a removable self-sealing a refrigeration unit. In the present invention, the storage container has an interior space accessible through an open front covered by a 2-part door. This door consists of an outer protective door and an inner door forming a barrier between an insulated portion of the storage container and the environment. The interior of the storage container is divided into insulated and uninsulated portions where the conditions of the insulated portion are protected. The refrigeration unit may be both self-sealing and self-aligning with the cabinet to ensure that the unit properly engages or mates to the interior of the storage container. This is accomplished in one embodiment by providing contoured edges with converging or tapered sidewalls of the refrigeration unit that are keyed to the opening in the housing.

Another technical advantage provided by the present invention includes the improved thermal responses of the refrigeration unit. In addition to the increased efficiency and minimized downtime, placing a temperature probe proximate to where peak temperatures affecting individual products are experienced ensures an improved response. Temperature information from the probe is used to direct the refrigeration unit to either heat or cool the insulated portion of the housing as needed. In the preferred embodiment, the temperature probe is located in the lower front portion of the machine where peak product temperatures are experienced from direct sunlight.

Still yet another technical advantages of the present invention is the transparent door assembly. This assembly allows clients to view their prospective purchases in a vending application. The outer door comprises an impact/scratch resistant layer formed from a material such as polycarbonate or LEXAN®. The inner door can serve as both an UV, IR and insulating barrier. This is achieved through the use of a multipaned assembly with insulating dead spaces located between panes coated with low emissivity coatings. These dead spaces are filled with dead air or inert gases such as Helium, Krypton, Argon and the like.

Yet another technical advantage provided by the present invention is the tamper or vandal resistant monetary system incorporated into vending embodiments of the present invention. The monetary unit and control panel is mounted to the frame allowing pivotal movement from a stored position within the cabinet to an accessible position allowing ease of service. The monetary unit is recessed within the door to prevent would be vandals from gaining access to interior components of the monetary unit.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein.

DETAILED DESCRIPTION OF THE INVENTION

Preferred embodiments of the present invention are illustrated in the FIGUREs, like numerals being used to refer to like and corresponding parts of various drawings.

The thermally regulated storage container of the present invention comprises a cabinet housing with an open face. A self-sealing and self-aligning cover provides an environmental seal between an insulated storage area within the cabinet housing and an external environment. A modular environmental control unit is removably installed within the cabinet. This unit can control temperature, pressure, humidity or any other environmental condition. A ducting system within the cabinet mates with the environmental control unit. An environmental monitoring system monitors internal conditions of the storage container and provides an input to a control system operable to direct the modular environmental control. This ensures that the desired internal conditions are maintained.

In an additional embodiment, the thermally regulated storage container of the present invention also includes a protective exterior layer constructed from a material such as a polycarbonate, thus protecting exterior surfaces from external conditions. This exterior may also incorporate anti-graffiti properties preventing unwanted destruction of the exterior surfaces of the present invention.

In yet another embodiment, the present invention may include a vending mechanism and product dispensing system. This allows the present invention to be used as an outdoor vending machine in a wide variety of environmentally hostile conditions while protecting an owner's interest in both the contents and the container itself.

Figure 1:
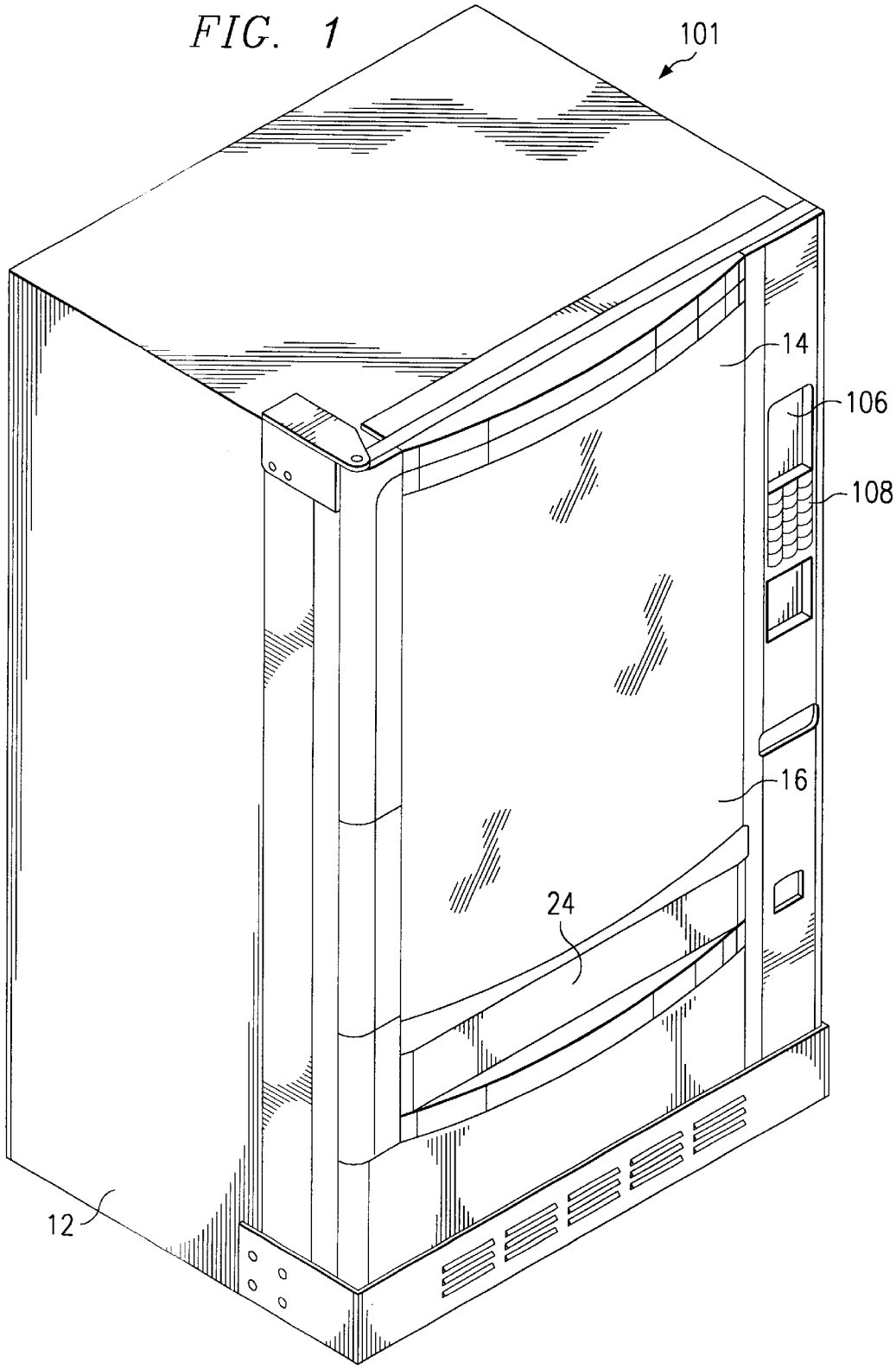
FIG. 1 is a perspective view of the preferred embodiment of the present invention.

In the preferred embodiment illustrated in FIG. 1, vending machine 10 comprises a cabinet 12 enclosed by a front service door 14. Door 14 is provided with a transparent front 16 that allows a customer to view the machine's contents for selection. An inner door 15 is shown in the cross-section provided in FIG. 2. Inner door 15 serves as an environmental or insulating boundary between the controlled conditions maintained within the cabinet 12 and exterior conditions. Additionally, depending on the optical qualities of the glass selected or applied coatings, inner door 15 may also serve as an UV and IR boundary. Inner door 15 comprises a plurality of parallel glass panes between which a dead space containing an inert gas such as Helium, Argon, Krypton and the like. In one embodiment, the present invention uses three parallel panes of glass or another similar material in order to provide two insulating dead spaces. It should be noted that the present invention is not limited to this configuration and may incorporate any number of insulating gaps or voids. This dead space serves as an insulating barrier while allowing a potential customer to view products offered for sale.

Product is supported in spirals 18 and supported by trays 20 or in another like manner. This configuration supports vending. However, the storage container of the present invention need not be limited to only vending applications.

Figure 2:
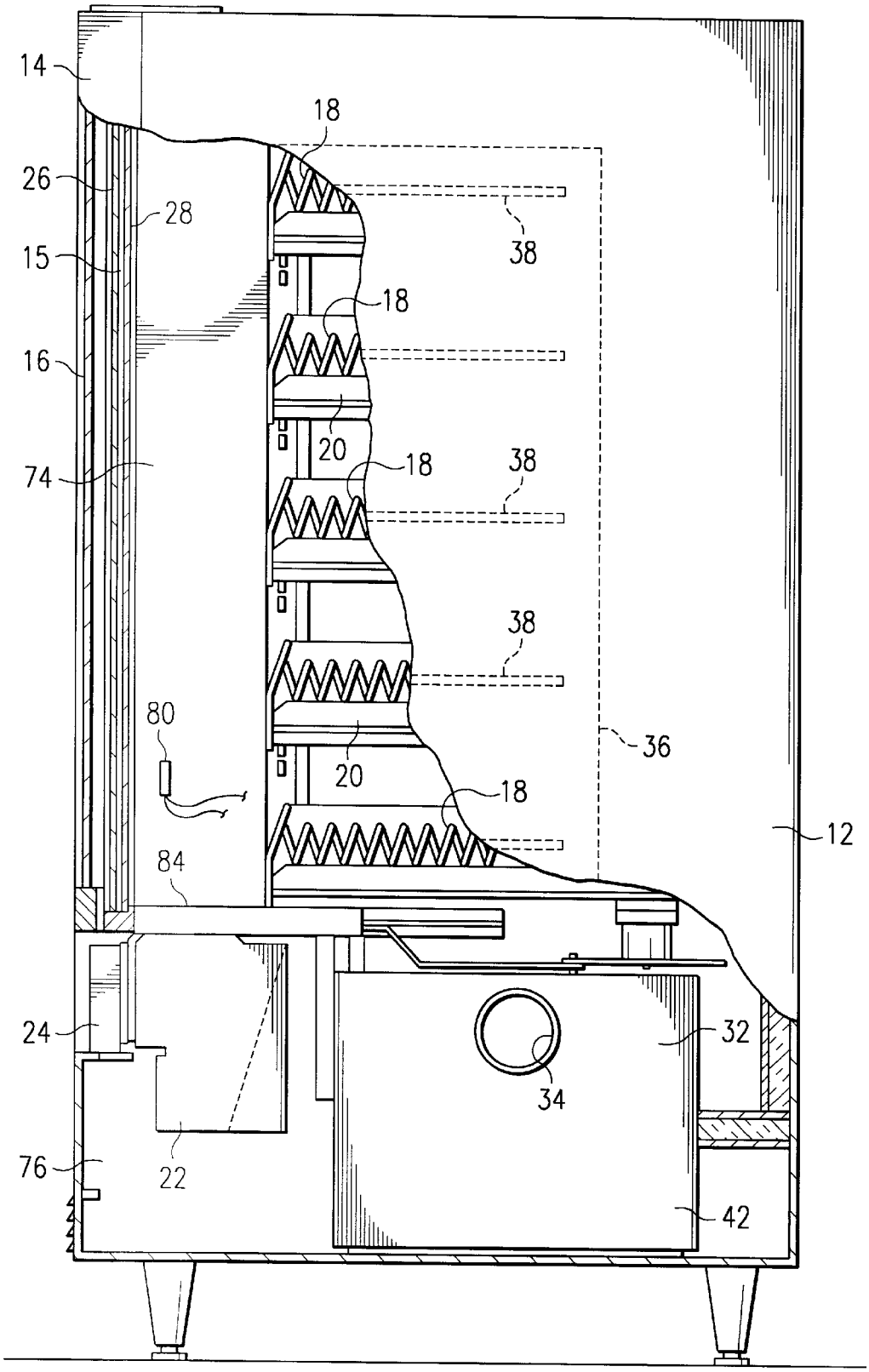
FIG. 2 is a side elevational view partially cutaway of the preferred embodiment.

In the vending configuration, vend bucket 22, best seen in FIG. 2, is disposed in the bottom of vending machine 10 and mounted to the inside of front door 14 for receiving product dispensed from shelves 20. Vend bucket door 24 is mounted to door 14 for pivotal movement to allow a customer to reach into vend bucket 22 to retrieve product that has been dispensed, but otherwise covers the entry to vend bucket 22.

An environmental control unit, such as refrigeration unit 32, is removably located at the bottom of vending machine 10. While a refrigeration unit 32 is shown, the present invention may incorporate a heating unit, humidifying unit, or other like device as known to those skilled in the art. Refrigeration unit 32 is coupled to cold air outlet duct 34. When refrigeration unit 32 is installed in the proper operating position within cabinet 12, cold air is directed from duct 34 into ducting system 36. Ducting system 36 distributes the cold air within cabinet 10 through ducted openings 38 proximate to product shelves 20. Thus, cold air flows over product and maintains product at the desired temperature.

Figure 3:
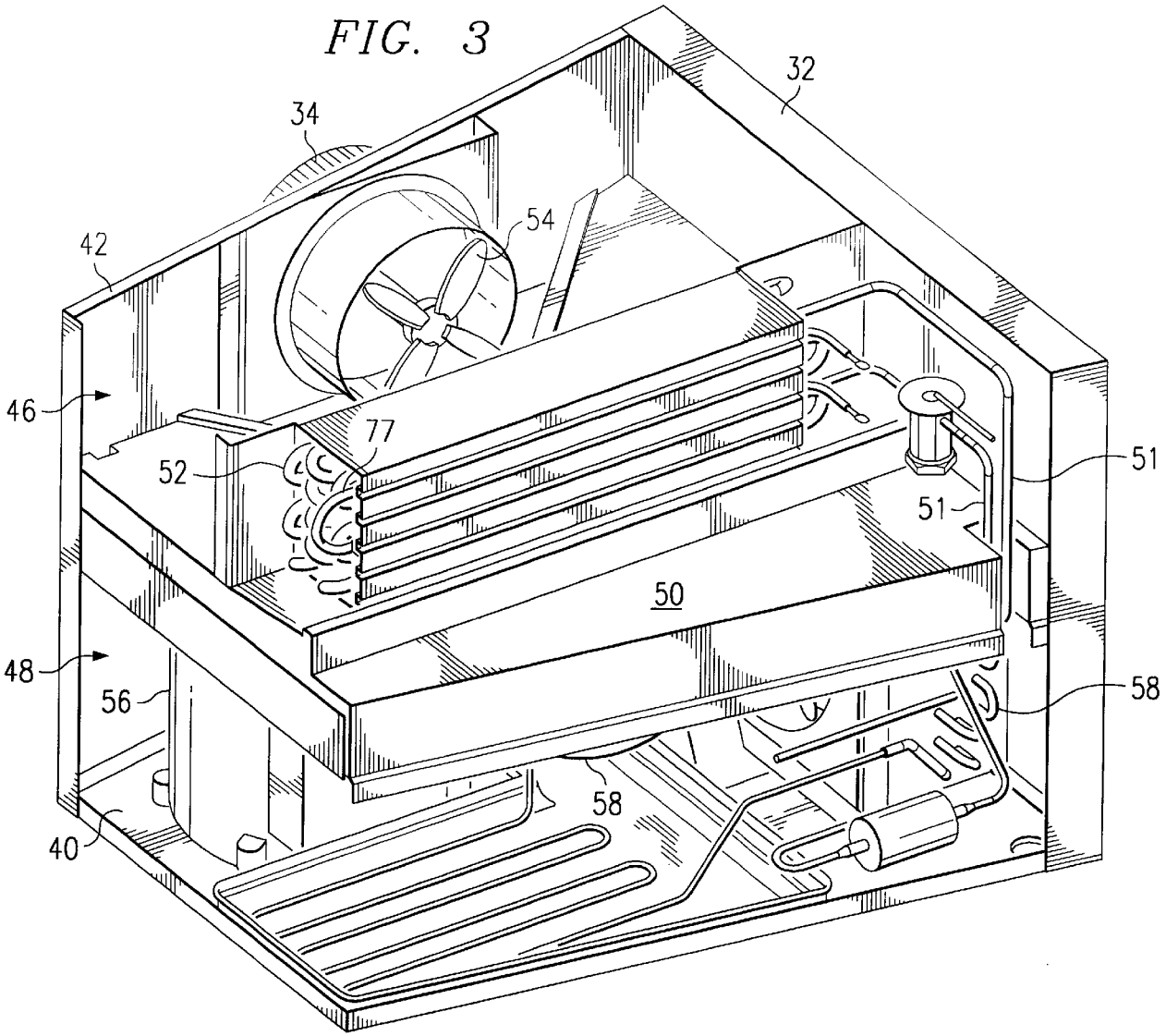
FIG. 3 is a perspective view of the refrigeration unit of the preferred embodiment with some outer panels removed for ease of viewing.
Figure 4:
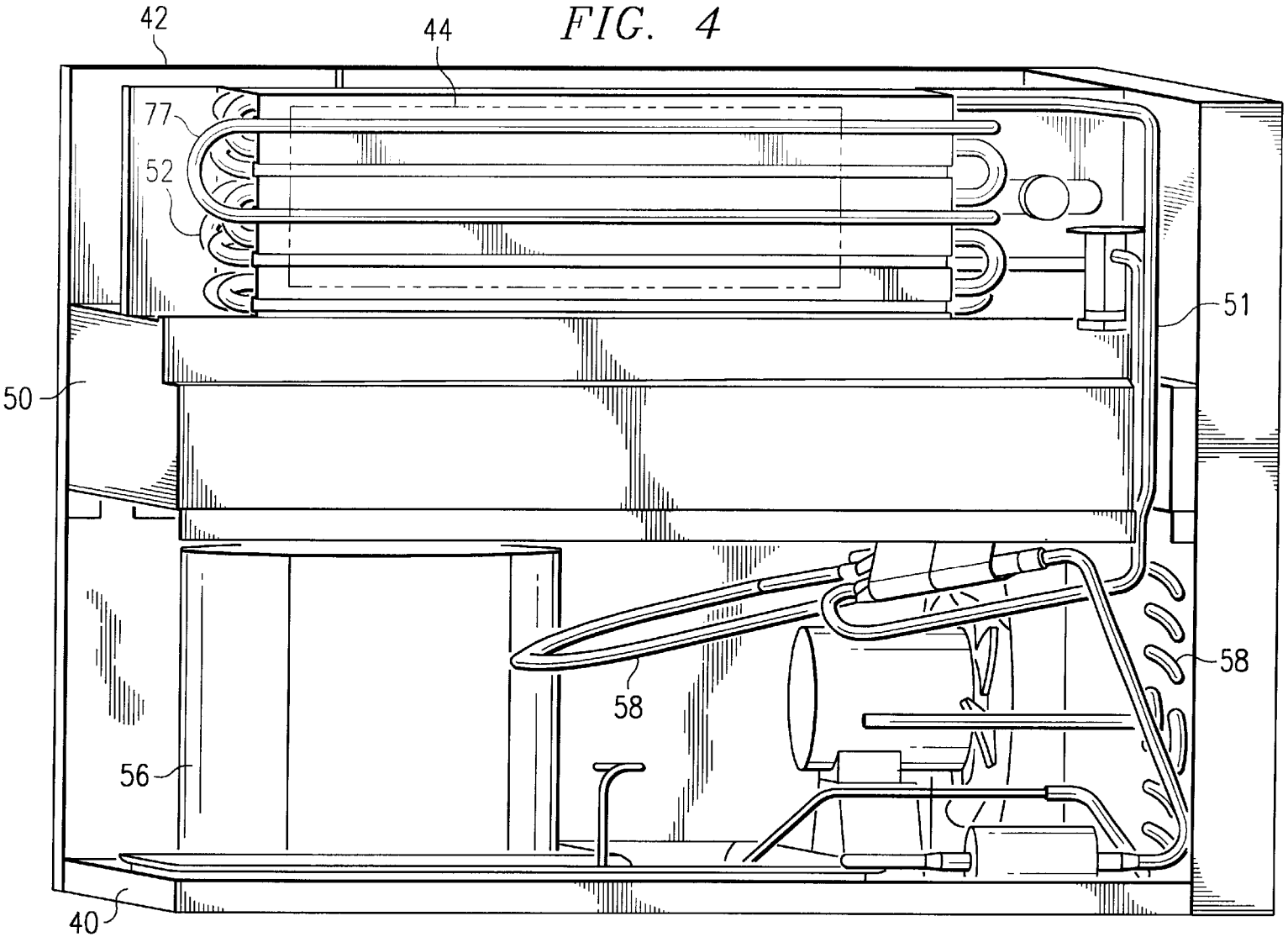
FIG. 4 is a side elevational view of the refrigeration unit of FIG. 3.

FIGS. 3 and 4 illustrate one embodiment of refrigeration unit 32 as comprising a housing made by floor panel 40, converging vertical sidewalls 42 and associated opposite side (not shown) removed. The opposite sides and rear vertical wall are not shown in order to illustrate the interior of refrigeration unit 32. A return air duct 44 is shown as part of removed vertical sidewall in FIG. 4. Refrigeration unit 32 is horizontally divided into upper portion 46 and lower portion 48 by horizontal plate 50. As shown, evaporator coils 52 are mounted in upper portion 46 adjacent evaporator fan 54. Evaporator fan 54 draws cold air out of evaporator coils 52 and into duct 34 for distribution within cabinet 36 as described above. A flexible tube is preferably used to connect the output duct 34 to ducting system 36. In lower portion 48 of refrigeration unit 32, compressor 56 and condenser coils 58 connect to evaporator coils 52 through tubing 51 passing through the plate 50.

Figure 5:
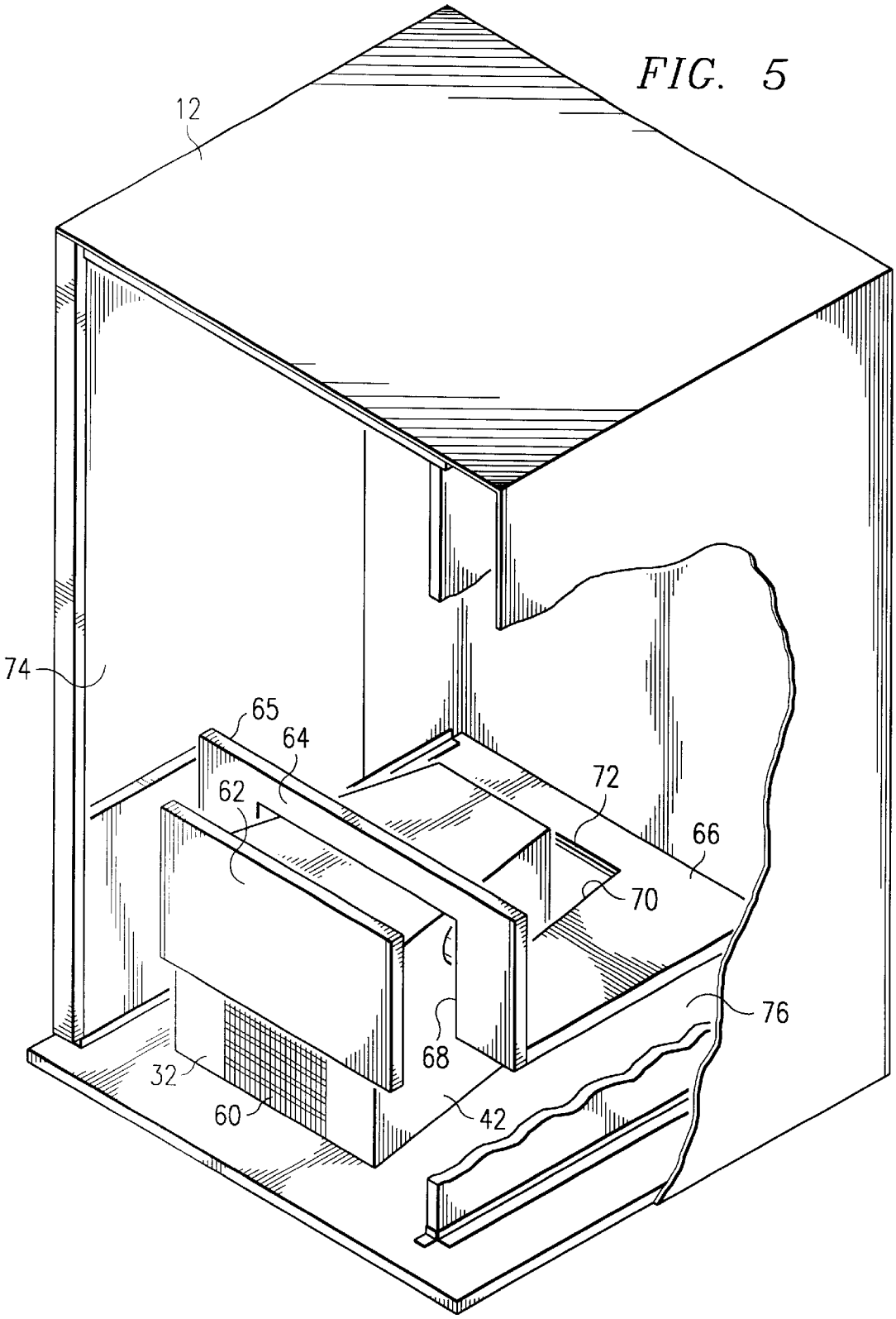
FIG. 5 is a perspective view partially cutaway and with some components removed of the preferred embodiment showing the refrigeration unit partially installed in the bottom of the cabinet.

Ambient air inlet 60, shown in FIG. 5, allows air into refrigeration unit 32. FIG. 5 illustrates how refrigeration unit 32 slides into position within cabinet 10 in a self-aligning manner.

Figure 6:
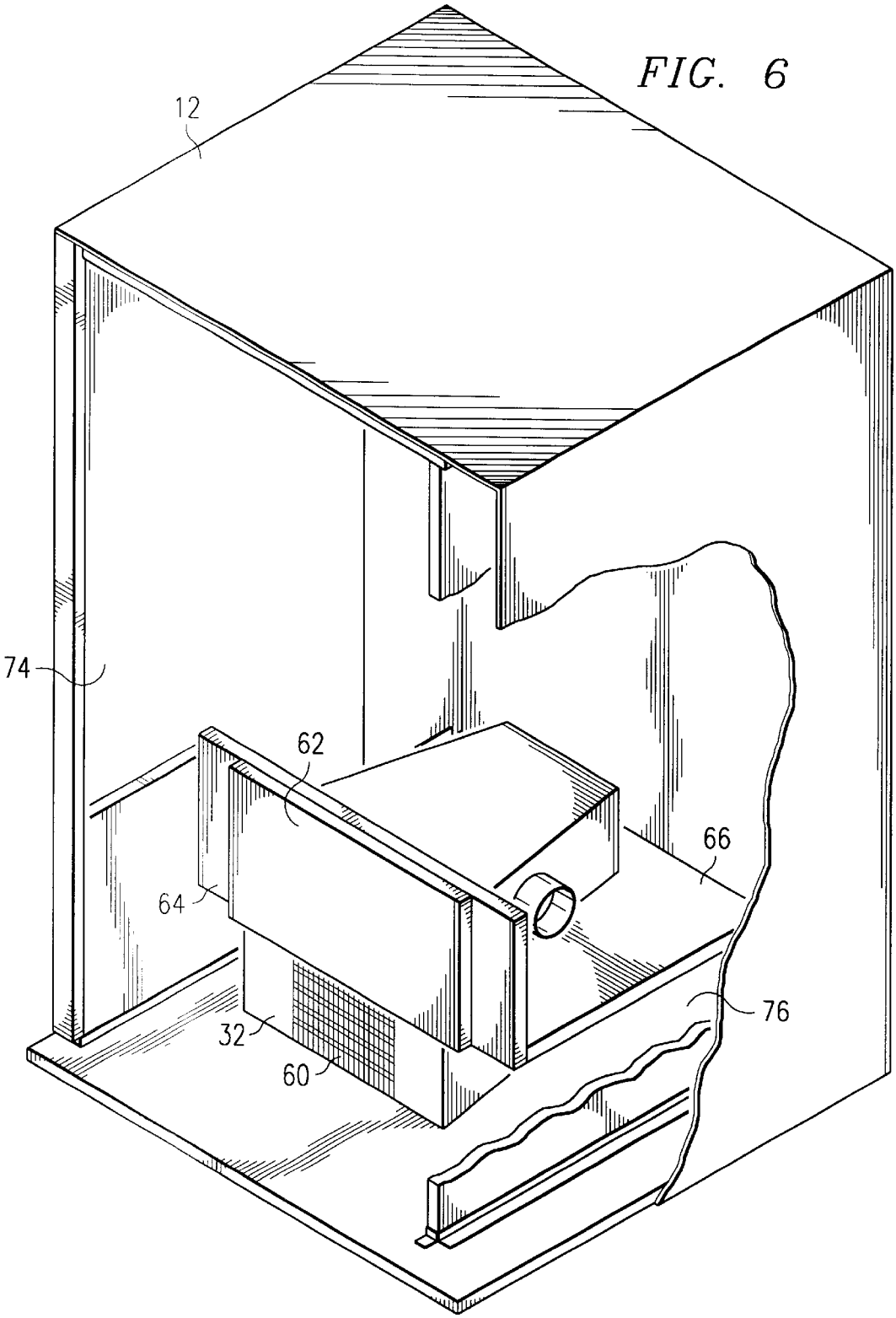
FIG. 6 is a view similar to that of FIG. 5 with the refrigeration unit fully installed in the bottom of the cabinet.

As seen in FIGS. 5 and 6, insulated panel 62 mounted to the front vertical wall 42 of refrigeration unit 32 engages front face 64 of stationary insulation panel 65 mounted in cabinet 12. An opening 68 formed in vertical panel 65 receives refrigeration unit 32. Insulated panel 62 butts up against front face 64 to form a self-aligning seal between modular refrigeration unit 32 and cabinet 10. Additional compressible sealing members may be used between the panels 62 and 65 to assist in sealing if desired. Tapered opening 68 similarly receives refrigeration unit 32. Converging sidewalls 70 and rear wall 72 preferably have vertical surfaces with compressible sealing members, which engage and seal against vertical side and back walls of refrigeration unit 32. In a broader sense, refrigeration unit 32, and panels 62 and 65 with their respective receiving openings, are so proportioned and arranged that refrigeration unit 32 can easily slide into place within cabinet 12 and simultaneously engage and seal against panels 62 and 65, providing an environmental barrier between an upper completely insulated portion 74 and a lower portion 76 of cabinet 12. Duct 34 in vertical side wall 42 and return air opening 44 in the opposite vertical side wall of refrigeration unit 32 may be both located within insulated upper portion 74 of cabinet 12 as shown in this embodiment. This ensures that the cold air circulation path stays within the insulated portion of the machine to reduce inefficiencies and losses by heat transfer. Other embodiments may include self-sealing surfaces that mate ducting surfaces of refrigeration unit 32 to ducting surfaces of cabinet 12.

In addition to the refrigeration cycle equipment located within refrigeration unit 32, heating coil 77 may be mounted adjacent to evaporator coils 52 to provide heated air to duct 34 and thus the insulated portion of cabinet 12 if necessary. This is a desirable feature, as storage cabinet 10 is designed to be used outdoors. In some climates having colder locations or seasons, it may be necessary to provide heat to preserve the product instead of refrigeration.

Once refrigeration unit 32 is installed, power and control circuits, as well as ducting systems 34, are connected to duct 36 providing temperature controlled air to insulated portion 74 of cabinet 12.

Figure 11:
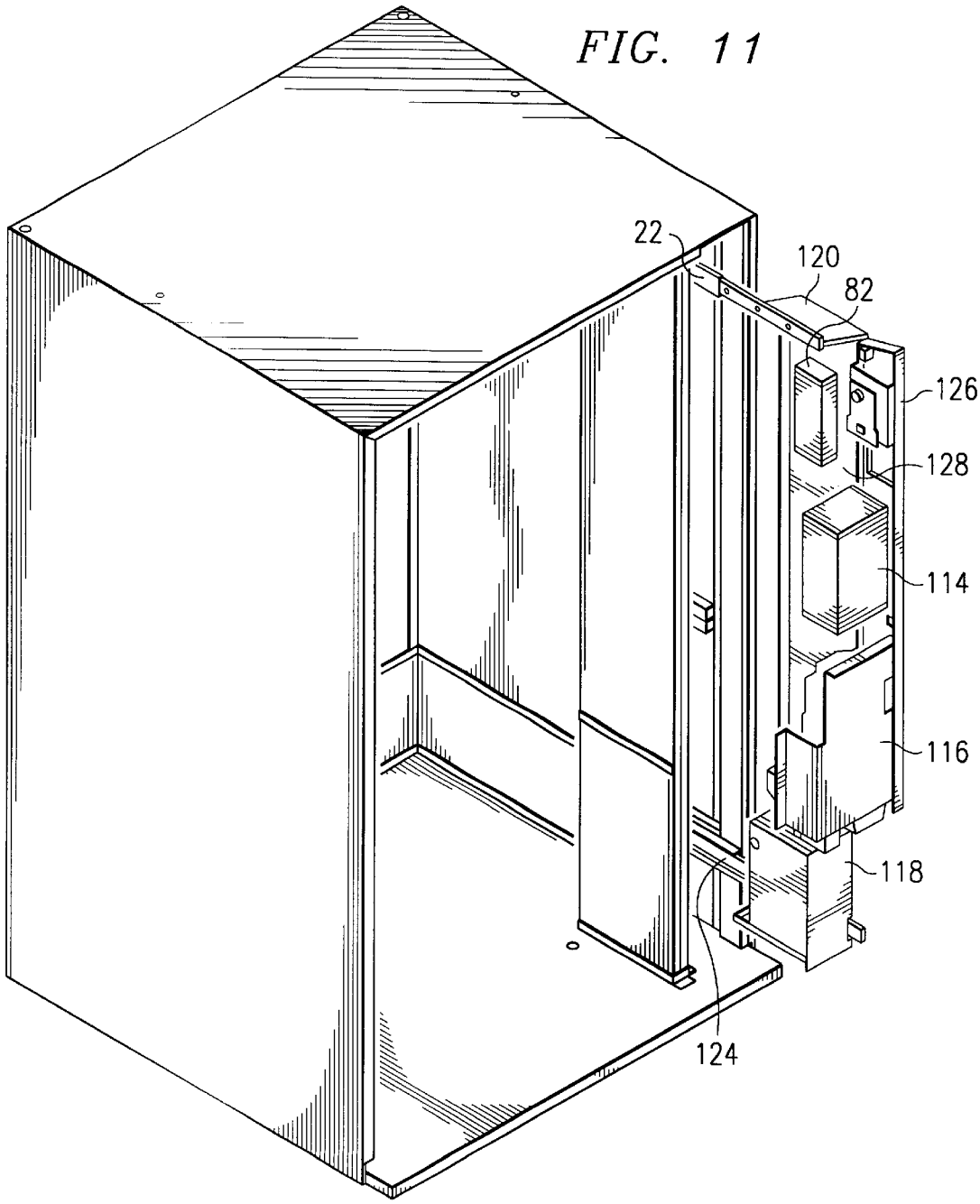
FIG. 11 is a perspective view similar to FIG. 10 with the monetary section pulled out of the cabinet and rotated.

The control circuit for refrigeration unit 32 includes thermistor 80, shown in FIG. 2, or similar temperature sensor, preferably positioned at the lower front portion of insulated upper portion 74 of cabinet 12 adjacent the lower shelves of product. In many cases, this will be the warmest location within insulated portion 74. By positioning sensor 80 at this approximate location, sensor 80 senses the warmest temperatures (where refrigeration is most needed). Sunlight may cause the greatest heating inside insulated portion 74 of cabinet 12 adjacent the lower portion of door 14. Thus, by determining the warmest temperature adjacent product items, the temperature of items most likely to be heated first can be kept at a desired temperature, preventing spoilage. Some temperature variation between the front and back of cabinet 12 may be present due to differences in circulating air temperatures. Sensor 80 provides an output to microprocessor 82. Microprocessor 82, as is shown in FIG. 11, is connected to refrigeration unit 32 and programmed to control refrigeration unit 32 and maintain desired environmental conditions within insulated portion 74.

Figure 7:
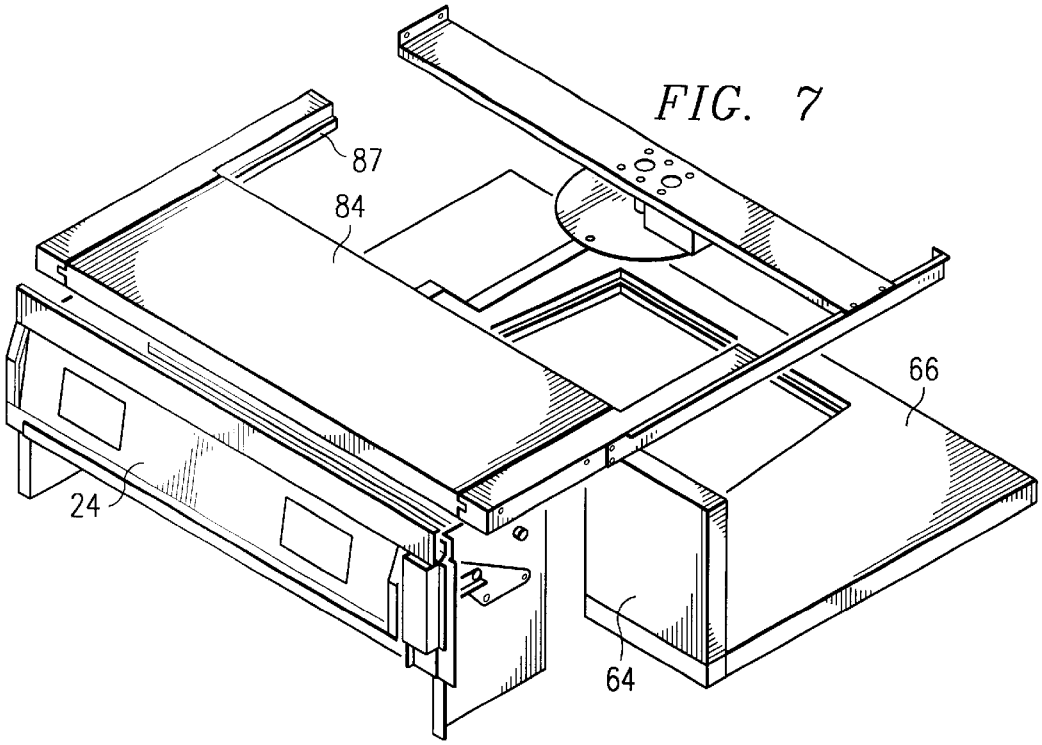
FIG. 7 is a perspective view of elements of the preferred embodiment Showing the closed position of the insulated door covering the vend bucket.
Figure 8:
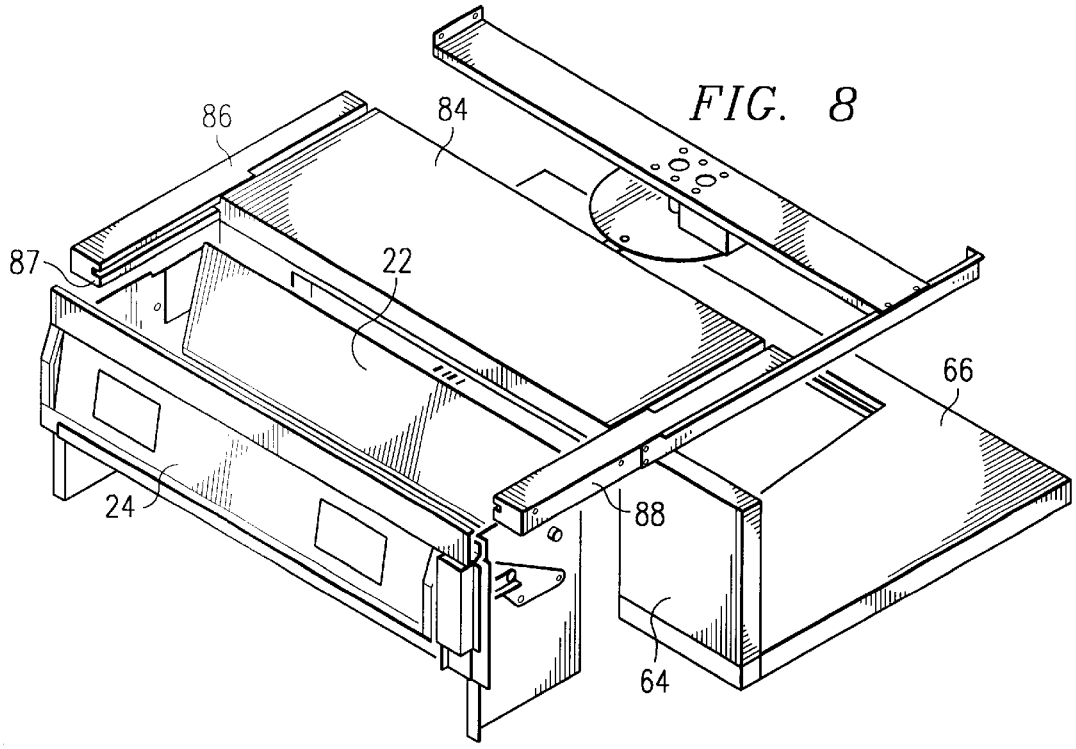
FIG. 8 is a perspective view similar to FIG. 7 with the insulated door in the open position for allowing vended products to enter the delivery pan.
Figure 9:
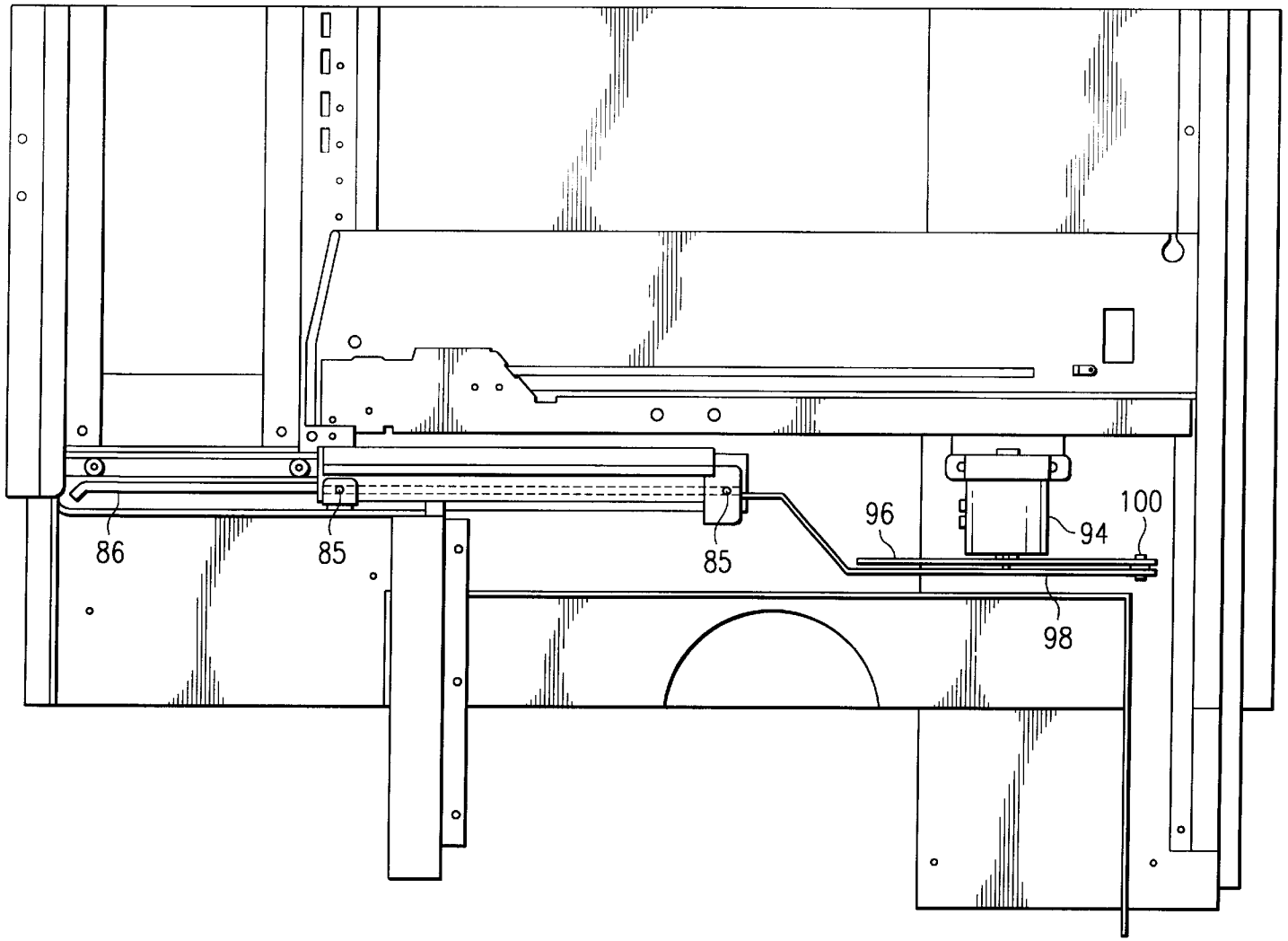
FIG. 9 is a partial side elevational view showing the insulated door in the open position as in FIG. 8.

In the vending embodiment of the present invention, a system and method must be provided that allows customers to access vended items while simultaneously maintaining an environmental boundary. In essence, a small volume of the cabinet is accessible from both insulated portion 74 and cabinet 10's exterior. However, this access is interlocked such that this volume is not simultaneously accessible from both insulated portion 74 and the cabinet's exterior. This interlocking access minimizes heat exchange between the cabinet exterior and insulated portion 74. This is accomplished through the use of vend bucket 22 shown in FIGS. 2 AND 7–8. Vend bucket 22 is sealed from the insulated portion 74 of cabinet 12 by sliding door 84. Sliding door 84 travels fore and aft along tracks 86 and 88 as illustrated in FIGS. 7 and 8 and in the forward position drop downward with a downward turn portion of tracks 86 and 88 and seal the vend bucket or delivery pan 22 from the insulated portion 74. Door 84 prevents a continuous loss of cooled or heated air through delivery pan access. Door 84 can be retracted to an aft position in order to allow product to drop from shelves 20 into vend bucket 22 in the usual manner. After product has dropped into the delivery pan, door 84 is returned to the forward position again sealing the delivery pan or vend bucket 22 from the insulated portion of the cabinet. To this end, door 84 is slidably mounted to move within two sets of pins 85 secured at the fore and aft portions of door 84 to restrict for and aft movement in tracks 86 and 88. Track 86 will be described with the understanding that track 88 is a mirror image thereof.

Track 86 supports door 84 for movement between a closed position shown in FIG. 7 and an open position shown in FIG. 8. In the closed position, door 84 rests upon a sealing surface 87 of tracks 86 and 88 and engages the back surface of inner door 15 to seal the insulated portion 74 from vend bucket 22. In the open position, shown in FIG. 8, door 84 is in the aft or remote position such that vend bucket 22 is able to receive product dispensed from shelves 20. Door 24 may be interlocked with interior flaps to provide security against would be vandals reaching into the machine.

Tracks 86 and 88 are provided at their forward ends 90 with a downward turned portion which causes forward pin 85 and the forward edge of door 84 to move downwardly, and a similar downward turned track 92 in the middle of tracks 86 and 88 which causes rear pin 85 and the back edge of door 84 to move downwardly simultaneously with the front end of the door which causes door 84 to come down on sealing surface 87 in tracks 86 and 88. The back and forth movement of door 84 in one embodiment is produced by the rotation of motor 94 coupled to a rotary crank. The rotary crank comprises disk 96 mounted to the drive shaft of motor 94 and a drive arm 98 rotatably connected by bolt 100 to disk 96 at one end and pinned at the other end of drive arm 98 to the rear of door 84 with a sufficiently loose connection to allow enough vertical movement of door 84 to move up and down on top of vend bucket as described above. Rotation of motor 94 is controlled by the microprocessor 82 so that when a customer makes a purchase of an item on shelves 20, door 84 is moved from its closed position to its opened position to allow the selected item to fall off the shelf into the vend bucket. After the item has dropped into vend bucket 22, door 84 is returned to the closed position.

Figure 10:
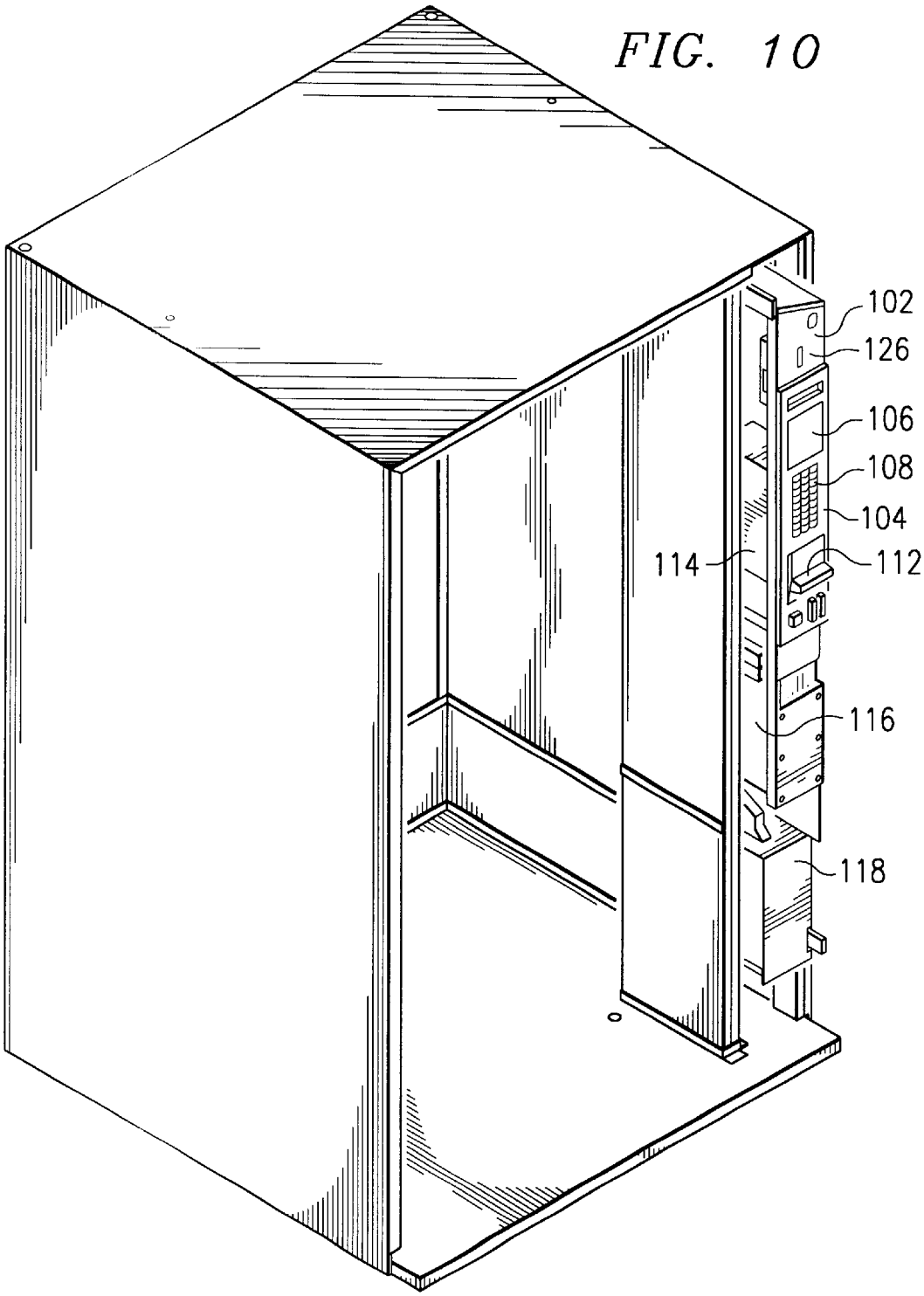
FIG. 10 is a perspective view of the cabinet and monetary portions of the preferred embodiment.

Monetary section 102 is shown in FIGS. 10 and 11. Monetary section 102 includes customer interactive area 104 having a message screen 106 and keyboard 108. As is well known in the art, this section is also used by the serviceman to program the microprocessor 82 to control operation of the machine 10. Additionally, microprocessor can be programmed to control the lighting and pricing of the products to be vended. The monetary section also contains a conventional bill validator 112 and paper currency storage area 114, a conventional coin mechanism 116 for accepting coins from a customer and giving change, and coin storage box 118. In additional embodiments, monetary section 102 includes a credit/debit card reader and/or network connection through which e-commerce sales can be transacted. Monetary section 102 is mounted to a slide-out frame 120 mounted on telescoping tracks 122 and 124 at the upper and lower portions of frame 120 which allow ease of access. In the normal closed position, monetary section 102 is recessed from outer door 14 to prevent unwanted access to its contents. Thus even if the outer door 14 is pried open, the monetary section 102 is still secure within a sheet metal or other such sheath. Front plate 126, to which all of monetary section 102 except the coin storage box 118 is mounted, is mounted at its top and bottom for pivotal movement to fixed panel 128 which is mounted directly to tracks 122 and 124. When in the storage position, as shown in FIG. 10, the monetary unit sets adjacent panel 128 which prevents vandals from attempting to pry open front door 14 and access bill validator 112 and currency storage area 114. When pulled out and rotated, as shown in FIG. 11, monetary section 102 is easily accessible for servicing and is easier to assemble when the machine is initially constructed.

In view of the above, it will be seen that the several objects of the invention are achieved and other advantageous results attained.

As various changes could be made in the above product and methods without departing from the scope of the invention, it is intended that all matter contained in the above description and shown in the accompanying drawings shall be interpreted as illustrative and not in a limiting sense.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the spirit and true scope of this invention as claimed below.

What is claimed is:

1. A thermally regulated storage container comprising:

a cabinet housing having at least one open face;

a modular environmental control unit, removably installed within said cabinet, having at least one duct;

a ducting system self-aligning and self-sealing to the at least one duct on the modular environmental control unit;

an environmental monitoring system operable to monitor an internal condition of the storage container;

a control system operable direct said modular environmental control unit to maintain said internal conditions through said at least one duct;

at least one self-sealing cover over said at least one open face that provides an environmental seal between a storage area within the storage container and an external environment; and a horizontal shelf dividing the cabinet housing into upper and lower portions, said shelf defining an opening keyed to receive said environmental control unit and form a self-aligning and self-sealing connection;

wherein said keyed opening has tapered converging sides and said sides of said refrigeration unit are similarly keyed.

2. The thermally regulated storage container of claim 1, further comprising:

an exterior layer to protect exterior surfaces of the storage container from said external environment.

3. The thermally regulated storage container of claim 1, said environmental control unit comprising a refrigeration unit, said refrigeration unit directed by said control system to maintain an internal temperature within a desired temperature band.

4. The thermally regulated storage container of claim 3, further including a heating member in said refrigeration unit.

5. The thermally regulated storage container of claim 1, wherein said at least one self-sealing cover comprises a multi-paned window coated with a low emissivity coating.

6. The thermally regulated storage container of claim 5, wherein said multi-paned window comprises a three-paned window with an inert gas atmosphere between said panes.

7. The thermally regulated storage container of claim 6, wherein said inert gas is Krypton.

8. The thermally regulated storage container of claim 1, wherein said modular environmental control unit is self-aligned and self-sealing with said cabinet.

9. The thermally regulated storage container of claim 1, wherein said shelf and upper portion of the housing are insulated.

10. The thermally regulated storage container of claim 1, further comprising a processor operable to control internal lighting of said cabinet.

11. A thermally regulated storage container comprising:

a cabinet housing having at least one open face;

a modular environmental control unit, removably installed within said cabinet, having at least one duct;

a ducting system self-aligning and self-sealing to the at least one duct on the modular environmental control unit;

an environmental monitoring system operable to monitor an internal condition of the storage container;

a control system operable direct said modular environmental control unit to maintain said internal conditions through said at least one duct; and at least one self-sealing cover over said at least one open face that provides an environmental seal between a storage area within the storage container and an external environment;

wherein said at least one self-sealing cover comprises an exterior and interior door, wherein both said exterior and interior doors are hingedly attached to the storage container at least one point, and wherein said exterior door is composed of a polycarbonate material, and said interior door comprises a multi-paned window.

12. The thermally regulated storage container of claim 11, wherein said interior door forms an environmental seal with an insulated portion of said storage container.

13. The thermally regulated storage container of claim 12, further comprising:

an internal insulating layer formed in place in said cabinet housing, wherein said multi-paned window serves as both an insulating boundary and UV or IR boundary;

a temperature sensor located in a region of the storage container exposed to peak environmental temperatures, wherein said temperature sensor provides an input to said control system;

a recessed monetary collection module to collect monetary units in exchange for vending said contents of the container through an associated vending mechanism; and a stable footprint to prevent tipping of the storage container.

14. The thermally regulated storage container of claim 13, further comprising a movable insulating barrier coupled to a vending bucket, the movable insulating barrier isolating said vending bucket from said insulated portion of said cabinet in a closed position and allowing product from said insulated portion of said cabinet to be dispensed to said vending bucket is an open position.

15. The thermally regulated storage container of claim 13, further comprising a microprocessor operable to control pricing of vended contents of said container.

16. A thermally regulated vending machine comprising:

a cabinet housing having at least one open face;

a modular environmental control unit removably installed within said cabinet;

a ducting system sealable to said modular environmental control unit;

an environmental monitoring system operable to monitor an internal condition of the vending machine;

a control system operable direct said modular environmental control unit to maintain said internal conditions;

at least one self-sealing cover over said at least one open face that provides an environmental seal between an insulated volume within the vending machine and an external environment; and a vending mechanism operable to vend contents of said cabinet in exchange for monetary units.

17. The thermally regulated vending machine of claim 16, further comprising an exterior layer to protect exterior surfaces of the vending machine from said external environment.

18. The thermally regulated vending machine of claim 16, wherein said environmental control unit is a refrigeration unit directed by said control system to maintain an internal temperature of said insulated volume within a desired temperature band.

19. The thermally regulated vending machine of claim 18, further including a heating member in said refrigeration unit.

20. The thermally regulated vending machine of claim 16, further comprising:

a temperature sensor located in a region of the vending machine exposed to peak environmental temperatures, wherein said temperature sensor provides an input to said control system.

21. The thermally regulated vending machine of claim 16, wherein said vending mechanism further comprises:

a recessed monetary collection module to collect said monetary units; and a vending bucket through which vended contents stored in said insulated volume are dispensed.

22. The thermally regulated vending machine of claim 16, wherein said vending machine has a stable footprint that prevents tipping of the vending machine.

23. The thermally regulated vending machine of claim 16, further comprising:

a shelf dividing the cabinet housing into a first and second portion, wherein said shelf is keyed to receive said environmental control unit.

24. The thermally regulated vending machine of claim 23, wherein said keyed opening engages said environmental control unit, wherein said environmental control unit is keyed to engage said keyed opening.

25. The thermally regulated vending machine of claim 16, wherein said vending mechanism further comprises a vending bucket having a first flap and a second flap interlocked to prevent simultaneous opening of said first and second doors.

26. The thermally regulated vending machine of claim 16, further comprising a processor operable to control internal lighting of said cabinet.

27. The thermally regulated vending machine of claim 16, further comprising a microprocessor operable to control pricing of vended contents.

28. The thermally regulated vending machine of claim 16 wherein said at least one self-sealing cover comprising a multi-paned window with a first and a second pane; and the thermally regulated vending machine further comprises an inert gas atmosphere disposed between said first pane and said second pane.

29. The thermally regulated vending machine of claim 28, the multipaned window comprising a third pane with an inert gas atmosphere between said second and said third panes.

30. The thermally regulated vending machine of claim 29, wherein said inert gas is Krypton.

31. The thermally regulated vending machine of claim 28, wherein said multi-paned window is coated with a low emmissivity coating.

32. A thermally regulated storage container comprising:

a cabinet housing having at least one open face;

a modular environmental control unit removably installed within said cabinet;

a ducting system sealable to said modular environmental control unit;

an environmental monitoring system operable to monitor an internal condition of the storage container;

a control system operable direct said modular environmental control unit to maintain said internal conditions;

at least one self-sealing cover over said at least one open face that provides an environmental seal between a storage area within the storage container and an external environment, the at least one self-sealing cover comprising an exterior and interior door, both said exterior and interior doors are hingedly attached to the storage container at least one point, and;

said interior door comprising a multi-paned window.

33. The thermally regulated vending machine of claim 32, wherein said interior door forms an environmental seal with said insulated volume.

34. The thermally regulated vending machine of claim 33, further comprising:

an internal insulating layer formed in place in said cabinet housing, and wherein said multi-paned window serves as both an insulating boundary and an UV and IR boundary.

35. The thermally regulated storage container of claim 32 further comprising:

a microprocessor operable to control pricing of vended contents of said container.

36. The thermally regulated storage container of claim 32 further comprising:

a microprocessor that controls distribution of contents of said container in response to a receipt of an economic benefit.

37. The thermally regulated storage container of claim 32 wherein said interior door forms an environmental seal with an insulated portion of said storage container.

38. The thermally regulated storage container of claim 37 further comprising:

an internal insulating layer formed in place in said cabinet housing, wherein said multi-paned window serves as both an insulating boundary and UV or IR boundary;

a temperature sensor located in a region of the storage container exposed to peak environmental temperatures, wherein said temperature sensor provides an input to said control system;

a recessed monetary collection module to collect monetary units in exchange for vending said contents of the container through an associated vending mechanism; and a stable footprint to prevent tipping of the storage container.

39. The thermally regulated storage container of claim 37, further comprising:

a movable insulating barrier coupled to a vending bucket that isolates the vending bucket from said insulated portion of said cabinet in a closed position and allows product from said insulated portion of said cabinet to be dispensed to said vending bucket is an open position.

40. A thermally regulated storage container comprising:

a cabinet housing having at least one open face;

an environmental control unit removably installed within said cabinet;

a ducting system sealable to said modular environmental control unit;

an environmental monitoring system operable to monitor an internal condition of the storage container;

a control system operable direct said modular environmental control unit to maintain said internal conditions;

a horizontal shelf dividing the cabinet housing into upper and lower portions, said shelf defining an opening keyed to receive said environmental control unit and form a self-aligning and self-sealing connection; and at least one self-sealing cover over said at least one open face that provides an environmental seal between a storage area within the storage container and an external environment.

41. The thermally regulated storage container of claim 40, wherein said keyed opening has tapered converging sides and said sides of said refrigeration unit are similarly keyed.

42. The thermally regulated storage container of claim 40, further comprising a movable insulating barrier coupled to a vending bucket that isolates the vending bucket from said insulated portion of said cabinet in a closed position and allows product from said insulated portion of said cabinet to be dispensed to said vending bucket is an open position.

43. The thermally regulated storage container of claim 40, wherein the shelf and upper portion of the housing are insulated.

44. The thermally regulated storage container of claim 40, further comprising a processor operable to control internal lighting of said cabinet.

45. A thermally regulated storage container for environmentally isolating an environment within said storage container from an external environment, the thermally regulated storage container comprising:

a cabinet housing having at least one open face;

at least one self-sealing cover over said at least one open face that provides an environmental seal between a storage area within said storage container and said external environment;

a ducting system environmentally coupled to the storage area;

a modular environmental control unit, removably installed within said cabinet and environmentally sealable to the ducting system, the modular environmental control unit comprising:

an environmental control mechanism, operable to alter said environment within said storage container; and a shell encasing said environmental mechanism;

the modular environmental control unit self-aligning and self-sealing to the cabinet when installed within said cabinet, said shell providing an environmental seal between said storage area and said external environment;

an environmental monitoring system operable to monitor an internal condition of the storage container;

a control system operable direct said modular environmental control unit to maintain said environment within said storage container; and at least one self-sealing cover over said at least one open face that provides an environmental seal between said storage area within said storage container and said external environment.

46. The thermally regulated storage container of claim 45, further comprising an exterior layer to protect exterior surfaces of the storage container from said external environment.

47. The thermally regulated storage container of claim 45, wherein said environmental control unit is a refrigeration unit directed by said control system to maintain an internal temperature within a desired temperature band.

48. The thermally regulated storage container of claim 47, further including a heating member in said refrigeration unit.

49. The thermally regulated storage container of claim 45, wherein said at least one self-sealing cover comprises a multi-paned window coated with a low emissivity coating.

50. The thermally regulated storage container of claim 49, wherein said multi-paned window comprises a three-paned window with an inert gas atmosphere between said panes.

51. The thermally regulated storage container of claim 50, wherein said inert gas is Krypton.

52. The thermally regulated storage container of claim 45, wherein said modular environmental control unit is self-aligned and self-sealing with said cabinet.

53. The thermally regulated storage container of claim 45, wherein said at least one self-sealing cover comprises an exterior and interior door, wherein both said exterior and interior doors are hingedly attached to the storage container at least one point, and wherein said exterior door is composed of a polycarbonate material, and said interior door comprises a multi-paned window.

54. The thermally regulated storage container of claim 53, wherein said interior door forms an environmental seal with an insulated portion of said storage container.

55. The thermally regulated storage container of claim 54, further comprising:

an internal insulating layer formed in place in said cabinet housing, wherein said multi-paned window serves as both an insulating boundary and UV or IR boundary;

a temperature sensor located in a region of the storage container exposed to peak environmental temperatures, wherein said temperature sensor provides an input to said control system;

a recessed monetary collection module to collect monetary units in exchange for vending said contents of the container through an associated vending mechanism; and a stable footprint to prevent tipping of the storage container.

56. The thermally regulated storage container of claim 55, further comprising a movable insulating barrier coupled to a vending bucket that isolates the vending bucket from said insulated portion of said cabinet in a closed position and allows product from said insulated portion of said cabinet to be dispensed to said vending bucket is an open position.

57. The thermally regulated storage container of claim 55, further comprising a microprocessor operable to control pricing of vended contents of said container.

58. The thermally regulated storage container of claim 45, further comprising:

a horizontal shelf dividing the cabinet housing into upper and lower portions, said shelf defining an opening keyed to receive said environmental control unit and form a self aligning and self-sealing connection.

59. The thermally regulated storage container of claim 58, wherein said keyed opening has tapered converging sides and said sides of said refrigeration unit are similarly keyed.

60. The thermally regulated storage container of claim 59, wherein the shelf and upper portion of the housing are insulated.

61. The thermally regulated storage container of claim 59, further comprising a processor operable to control internal lighting of said cabinet.

62. A thermally regulated storage container comprising:

a cabinet housing having at least one open face;

an environmental control unit installed within said cabinet;

a ducting system sealable to said modular environmental control unit;

an environmental sensor that monitors an internal condition of the storage container, the environmental sensor located in an approximate region of the storage container exposed to extremes of internal conditions within the cabinet, wherein said sensor provides an input to said control system;

a control system, communicatively coupled to said environmental control unit and to the environmental sensor, that directs said environmental control unit to maintain said internal conditions; and at least one self-sealing cover over said at least one open face that provides an environmental seal between a storage area within the storage container and an external environment.

* * * * *

UNITED STATES PATENT AND TRADEMARK OFFICE

CERTIFICATE OF CORRECTION

PATENT NO. : 6,378,324 B1 
DATED : April 30, 2002
INVENTOR(S) : Charles W. Percy and John P. Huffman It is certified that error appears in the above-identified patent and that said Letters Patent is hereby corrected as shown below:

Title page,
Item [56], References Cited, U.S. PATENT DOCUMENTS, "4,730,450" should be -- 4,730,750 --.

Signed and Sealed this

Twenty-eighth Day of October, 2003

JAMES E. ROGAN
*Director of the United States Patent and Trademark Office*